US009622596B2

(12) United States Patent
Trainor-Smith et al.

(10) Patent No.: US 9,622,596 B2
(45) Date of Patent: Apr. 18, 2017

(54) BRACELET HOOK

(71) Applicant: STS Innovation & Design, LLC, Fairfield, CT (US)

(72) Inventors: Sharon Trainor-Smith, Fairfield, CT (US); Mark Henry Méndez, Wappingers Falls, NY (US)

(73) Assignee: STS Innovation & Design, LLC, Fairfield, CT (US)

( * ) Notice: Subject to any disclaimer, the term of this patent is extended or adjusted under 35 U.S.C. 154(b) by 0 days.

(21) Appl. No.: 15/200,033

(22) Filed: Jul. 1, 2016

(65) Prior Publication Data

US 2016/0309923 A1 Oct. 27, 2016

Related U.S. Application Data

(62) Division of application No. 14/433,042, filed as application No. PCT/US2014/048345 on Jul. 28, 2014, now Pat. No. 9,392,889.

(60) Provisional application No. 61/860,358, filed on Jul. 31, 2013.

(51) Int. Cl.

| | |
|---|---|
| ***A47F 7/02*** | (2006.01) |
| ***A47G 29/00*** | (2006.01) |
| ***A47F 5/01*** | (2006.01) |
| ***A47F 5/13*** | (2006.01) |
| ***A47B 49/00*** | (2006.01) |
| ***A47B 67/00*** | (2006.01) |
| ***A47B 96/02*** | (2006.01) |
| ***A47F 5/02*** | (2006.01) |

(Continued)

(52) U.S. Cl.

CPC ..... *A47F 7/022* (2013.01); *A47B 49/004* (2013.01); *A47B 67/005* (2013.01); *A47B 96/021* (2013.01); *A47F 5/0006* (2013.01); *A47F 5/01* (2013.01); *A47F 5/02* (2013.01); *A47F 5/0838* (2013.01); *A47F 5/132* (2013.01); *A47F 7/02* (2013.01)

(58) Field of Classification Search

CPC . A47F 5/0861; A47F 5/0823; Y10T 24/45277
USPC ..... 248/290.1, 302, 303, 304, 305, 339
See application file for complete search history.

(56) References Cited

U.S. PATENT DOCUMENTS 2,743,023 A * 4/1956 Larson ..... A47G 25/0685 211/96
4,114,763 A * 9/1978 Hochman ..... A47F 5/0823 211/107

(Continued)

FOREIGN PATENT DOCUMENTS

WO WO 2011/029192 A1 3/2011

OTHER PUBLICATIONS

European Search Report for Application 14832862.8 dated Jun. 1, 2016.

(Continued)

*Primary Examiner* — Daniel J Troy
*Assistant Examiner* — Kimberley S Wright
(74) *Attorney, Agent, or Firm* — Mark Nowotarski

(57) ABSTRACT

A bracelet hook for holding bracelets has a clip for mounting onto parallel mounting bars of a jewelry organizer stand and an upper arm and a lower arm for holding bracelets. The upper arm has a hook that can clip into the lower arm so that the bracelet hook can be closed and hold bracelets for shipping.

8 Claims, 13 Drawing Sheets

(51) Int. Cl.
*A47F 5/08* (2006.01)
*A47F 5/00* (2006.01)

(56) References Cited

U.S. PATENT DOCUMENTS 4,286,764 A * 9/1981 Pfeifer ..... A47F 5/0869 248/220.22
4,324,446 A 4/1982 LeSage
4,390,099 A 6/1983 Trautlein et al.
4,520,978 A * 6/1985 Taub ..... A47F 5/0823 211/57.1
4,750,698 A * 6/1988 Barnes ..... A47F 5/0869 211/59.1
4,783,033 A * 11/1988 Valiulis ..... A47F 5/0823 211/59.1
4,832,298 A 5/1989 Metcalf
4,966,287 A 10/1990 Snyder
D316,729 S 5/1991 Crowley
5,038,943 A 8/1991 Reinke
5,054,624 A 10/1991 Camp
5,116,003 A * 5/1992 Gerhardt ..... A47L 13/512 248/113
5,242,048 A 9/1993 Ellingsworth et al.
5,248,047 A 9/1993 Randhawa
5,322,256 A * 6/1994 Kanwischer ..... A47L 13/512 211/65
5,472,167 A * 12/1995 Shillington ..... A47F 5/0853 211/94.01
5,887,731 A 3/1999 Thalenfeld
6,234,330 B1 5/2001 Gray
6,254,053 B1 * 7/2001 Taser ..... B25H 3/04 248/113
6,425,647 B1 7/2002 Pothin
6,659,291 B2 * 12/2003 Huehner ..... A47F 5/0861 211/4
6,811,128 B1 * 11/2004 Wagner ..... A47F 5/0823 211/57.1
6,957,555 B1 * 10/2005 Nagel ..... A47F 5/0861 211/57.1
7,197,902 B1 * 4/2007 Barkdoll ..... A47F 5/0861 211/57.1
7,314,203 B2 1/2008 Yue
7,392,673 B2 * 7/2008 Fawcett ..... A47F 5/0861 211/7
7,584,930 B2 * 9/2009 Zich ..... A47F 5/0861 211/57.1
7,617,942 B2 11/2009 Albanese
7,775,492 B2 * 8/2010 Pierzynski ..... A47F 5/0807 211/87.01
7,798,338 B2 * 9/2010 Maheu ..... A47F 5/0815 211/103
7,909,183 B2 * 3/2011 Oh ..... A47F 5/0823 211/59.1
8,286,454 B2 * 10/2012 Richardson ..... A47F 5/0861 211/7
8,534,469 B2 * 9/2013 Northrup, Jr. ..... A47F 5/0861 211/57.1
8,651,291 B1 2/2014 Prather
8,794,453 B2 * 8/2014 Kologe ..... A47F 5/0861 211/57.1
9,314,918 B2 * 4/2016 Wilbs ..... B25H 3/04
2003/0029816 A1 * 2/2003 Huehner ..... A47F 5/0861 211/7
2004/0016670 A1 1/2004 Lewand et al.
2004/0084386 A1 * 5/2004 Huehner ..... A47F 5/0861 211/4
2006/0067661 A1 * 3/2006 Pierzynski ..... B25H 3/04 396/71
2007/0193969 A1 8/2007 Albanese
2007/0267557 A1 * 11/2007 Zich ..... A47F 5/0861 248/220.41
2009/0057244 A1 * 3/2009 Conti ..... A47F 5/0861 211/7
2009/0065373 A1 3/2009 Kornowski
2009/0095695 A1 * 4/2009 Moock ..... A47F 5/0861 211/57.1
2009/0266953 A1 10/2009 Goldstein et al.
2010/0206825 A1 * 8/2010 Johnston ..... A47F 5/0853 211/59.2
2010/0223965 A1 * 9/2010 Richardson ..... A47F 5/0861 70/58
2012/0062087 A1 3/2012 Havlock et al.
2013/0008863 A1 1/2013 Valiulis
2013/0026120 A1 1/2013 Johnson
2013/0105418 A1 * 5/2013 Northrup, Jr. ..... A47F 5/0861 211/4
2013/0105419 A1 * 5/2013 Kologe ..... A47F 5/0861 211/7
2014/0000323 A1 * 1/2014 Kologe ..... A47F 5/0861 70/58

OTHER PUBLICATIONS

Lucky Line Products, Inc., Hook Key Ring, last viewed Jul. 10, 2013.
Amazon.com, Stanley Hardward 819841 Pegboard Hook Assortment, 51-Piece, last viewed Jun. 20, 2016.
LuLuSoSo.com, Countertop Rotating Metal Jewelry Tree Display Stand with Pigtail Sign Holder, last viewed Jul. 10, 2013.
George Patton Associates, Inc., Displays2Go.com, The Jewelry Holder is an All-In-one Jewelry Display Fixture! Jewelry Holder: has a Rotating Frame, http://www.displays2go.com/P-12983/Jewelry-Holder-has-a-Rotating-Frame, Jul. 10, 2013.
LuLuSoSo.com Inc., Wholesale Display Stand for pandora, chamilia, biagi charms, http://sell.lulusoso.com/selling-leads/178420/Wholesale-Display-Stand-f, Jul. 10, 2013.
Lucky Line Products, Inc., Hook Key Ring, Jul. 10, 2013.
LuLuSoSo.com Inc., JD024 Hello Kitty metal Iron Jewelry Display Stand holder earring stand, http://sell.lulusoso.com/selling-leads/448804/JK024-HELLO-KITTY-met, 2012.
LuLuSoSo.com Inc., jewelry display stand, acrylic jewelry stand necklace earrings, http://sell.lulusoso.com/selling-leads/244363/jewelry-display-stand-acryli, 2011.
Molly N Me Jewelry Holder—Beaded Wire Mannequin—white, Jul. 10, 2013.
The Longstem Corner Jewelry Organizer, http://web.archive.org/web/20121215021412/http://www.longstem.com/, Dec. 15, 2012.
LuLuSoSo.com Inc., Countertop Rotating Metal Jewelry Tree Display Stand with Pigtail Sign Holder, http://sell.lulusoso.com/selling-leads/1207401/Countertop-Rotating-Meta, Jul. 10, 2013.
PCT Search and Opinion PCT/US2014/048345, Nov. 28, 2014.

* cited by examiner

BRACELET HOOK

TECHNICAL FIELD

The inventions described herein are in the field of jewelry organizers.

BACKGROUND ART

Many women have much more jewelry than they have accessible places to store it. But women love their jewelry and consider it a very personal expression of themselves, their good taste and their personalities. They wear different kinds of jewelry for different occasions, such as, one type of jewelry for 'work', something else for holidays or fancy parties, and another type for casual weekends. Women frequently get jewelry as gifts, and also buy jewelry for themselves, even in a down economy. So their collections continue to grow. Recent trends in jewelry have emphasized 'collections'—Pandora® beads, Alex & Ani® stacking bracelets, interchangeable magnet and snap-on rings and bracelets—which create even greater storage challenges.

But their main complaint is that they don't have a good place to store all their jewelry. As a result, they can't see it all at once so they can't remember what they have; they toss things together, especially necklaces, and end up with a big tangled wad of chains; or they lose pieces, particularly earrings, because they don't have one central, quick, easy place to put them at the end of the day. Commercial jewelry boxes and cabinets, and most do-it-yourself solutions, are only able to hold a limited amount and type of jewelry, so the problem continues. Or they are cumbersome (for example, stacking boxes that go in your dresser drawers) because they require that you remove layers to find what you are looking for, and it takes too much time or uses up too much space.

There is need, therefore, for a jewelry organizer that can store, display and make readily accessible a large number of a wide variety of jewelry items.

DISCLOSURE OF INVENTION

A Jewelry Organizer Stand comprises a frame and a base. The frame may be rotatable about the base. The frame has provision for a variety of different jewelry items, such as earrings, pins, bracelets, large-hole beads and charms, pendants, rings, and necklaces. The frame may comprise a mesh screen region for storing pin-type jewelry items. Exemplary pin-type jewelry items include but are not limited to hook or post-mounted jewelry, such as French hook, lever-backed, or stud-backed earrings. The mesh is adapted to hold said pin-type jewelry items by virtue of the hole size therein and material strength. The holes must be sized to allow insertion of a pin with sufficient friction to hold said pin in once inserted. The material must be strong enough to hold said pin in once inserted.

The frame may further comprise a mounting bar region for mounting clips with extensions. The mounting bar region comprises two or more horizontal bars. The clips are adapted to snap onto said bars. The extensions may be adapted to hold loop-type jewelry. Loop-type jewelry includes, but is not limited to, beads, charms, pendants, bracelets, rings and necklaces.

The frame may further comprise an open frame region. The open frame region may be adapted to hold linear-type items. Linear-type items include, but are not limited to, scarves, belts, and hats.

Different jewelry items and accessories may be arranged for easy review, convenient access, personal preference and high capacity storage on the Jewelry Organizer Stand. The jewelry items may be locked-in so that the organizer can be transported when fully loaded with said items. The frame may have a form with aesthetic appeal, such as a female outline. The frame may be free-standing on a floor and rotatably mounted on a base.

BEST MODE FOR CARRYING OUT THE INVENTION

The detailed description describes non-limiting exemplary embodiments. Any individual features may be combined with other features as required by different applications for at least the benefits described herein. As used herein, the term "about" means plus or minus 10% of a given value unless specifically indicated otherwise.

Figure 1:
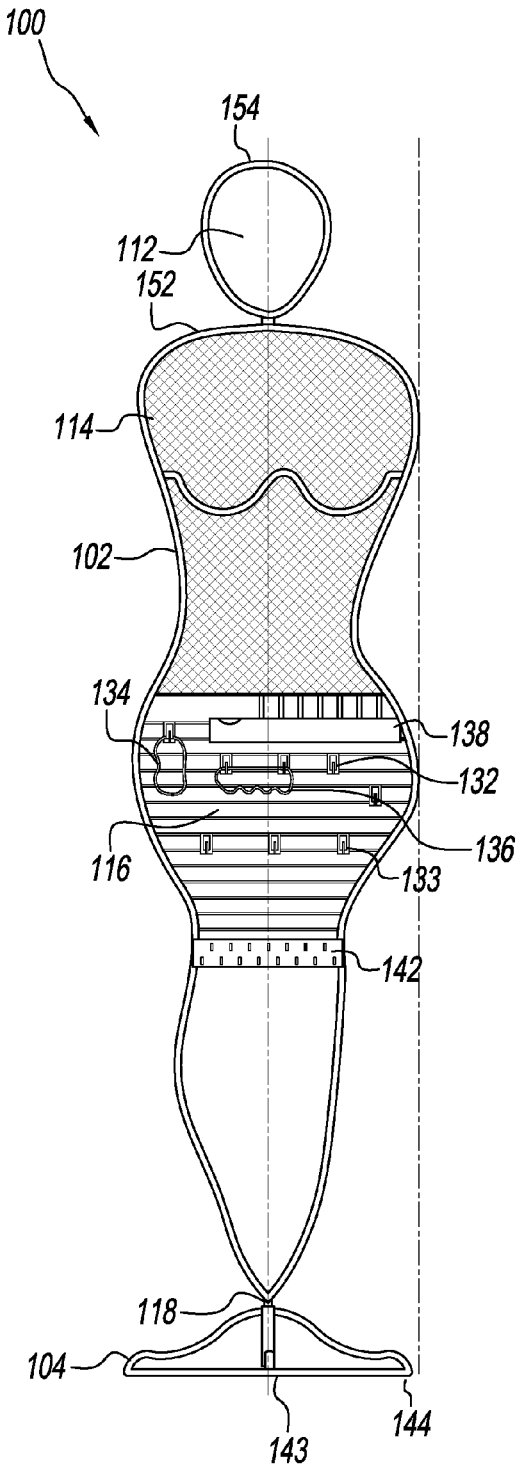
FIG. 1 is a front view of a Venus embodiment of a Jewelry Organizer Stand.

FIG. 1 is a front view of an exemplary Jewelry Organizer Stand 100. The organizer comprises a frame 102 and a base 104. The frame may be made of a stiff material that can hold its shape. Metal, wood and plastic are suitable materials. Alloy 6061 aluminum tubing with about a 0.953 cm diameter is suitable. The tubing may be joined by welding and may be powder coated. Any color or finish of suitable aesthetics may be used. Suitable colors and finishes include gloss white, satin or matte silver, and matte black. The frame may be formed to a suitable aesthetic shape.

The form illustrated in FIG. 1 is a female form termed "Venus". The frame may be about the height of a typical adult woman. The height to the shoulders of the frame 152 may be about 147 cm. The height to the top of the head 154 may be about 173 cm. A non-limiting suitable range of heights to the top of the head are 152 cm to 183 cm. Smaller frames may be suitable for children. Larger frames may be suitable for men or tall women (e.g. basketball players). The frame may have a fanciful shape, such as a tree, animal, or mythical character. Masculine shapes (e.g. generic "butlers" or Chippendales® men) may be used. The open frame region and base may be removable for shipping.

The frame may comprise different mounting regions.

Open Frame Region

One or more open frame regions 112 may be provided. An open frame region may be removable, such as by unscrewing from the main frame. Alternative open frames, such as heads with features, stiff hair projections that can be used as hooks, tilting mirrors or other configurations are suitable. Open frame regions are suitable for holding scarves, belts and other flexible linear items. The flexible linear items are passed through the frame and draped upon it. Open frame regions can also be suitable for cupped linear items, such as hats, wigs or hair extensions. The cupped items are placed over the open frame region. Additionally open frame regions are suitable for clamping or folding items such as hair clips, barrettes or sunglasses. Folding items can be draped upon an open frame region. Clamping items can be clamped upon an open frame region.

Mesh Screen Region

One or more mesh screen regions 114 may be provided. Mesh screen regions comprise a supported mesh for holding pin-type jewelry items. Pin-type jewelry items include earrings, pins and other post-mounted items. Suitable meshes include metal screens, plastic screens and woven or knitted fabrics. Suitable supports include frames that the mesh may be attached to. The screen may be a standard aluminum window screen material with holes-per-cm of about 7.09× 5.51. 7.09×5.12 is also suitable. The screen holes should be large enough to hold standard sized post/stud earrings and French hook earrings snugly. If the holes are too large, then the earrings could fall out or droop down and do not look good. Wire mesh screens allow a user to see through the form which gives it a more ethereal and artistic look. Alternatively, solid metal sheet with an array of holes punched in it may be used if a different aesthetic or higher strength is desired. Heavier pin-type jewelry items, such as Body piercing jewelry or men's accessories, such as cuff links, tie tacks and tie bars, might require a higher strength screen.

Mounting Bar Region

One or more mounting bar regions 116 may be provided. Mounting bars are parallel metal bars that serve as supports for clips with extensions 132. A suitable bar-to-bar spacing is about 2.06 cm. A suitable diameter for said bars is about 0.159 cm. The bars may be made of plastic, wood, powder coated steel, aluminum, or other suitable metals. A suitable bar orientation is about horizontal. Angled and vertical orientations are suitable if the clips snap on with sufficient force.

Clips may be removable and/or slideable. Clips may have one or more different extensions. Said extensions may be adapted to hold loop-type jewelry or accessories, such as bracelets, rings and necklaces. Different extensions include a cantilever 133. Cantilevers may be adapted for holding bracelets, bead spin-rings 134 and pendant spin-rings 136. Spin-rings are described in more detail below. Another extension is a ring bar 138 for holding rings on vertical posts. The ring bar may further comprise a cup for holding earring backs or stoppers. Another extension is a necklace bar 142 for holding necklaces. Necklace bars comprise horizontal cantilevers that necklaces are draped on. Ring bars and necklace bars may comprise two or more clips for attachment onto mounting bars. The two or more clips hold the ring or necklace bars in a horizontal orientation. The two or more clips may be positioned in an offset manner on said ring or necklace bars to allow two ring or necklace bars to be mounted back-to-back on the same segment of mounting bars.

Dimensions

Relative to the height of a typical adult woman, the open frame region may extend from the top of said typical woman's head to the top of said typical woman's shoulders. The span in height of said open frame region may be in the range of 20.3 to 30.5 cm. The mesh screen region may extend from the top of said typical woman's shoulders to said typical woman's waist. The span in height of said mesh screen region may be in the range of 30.5 to 91.4 cm. The mounting bar region may extend from said typical woman's waist to said typical woman's knees. The span in height of said mounting bar region may be in the range of 30.5 to 91.4 cm. A typical adult woman's height may be in the range of 152 cm to 183 cm. The height of a typical woman's shoulders may be in the range of 122 cm to 152 cm. The height of a typical woman's waist may be in the range of 61.0 cm to 91.4 cm. The height of a typical woman's knees may be in the range of 30.5 cm to 45.7 cm.

Base

The frame may comprise a stand pole 118 which extends into the base. The stand pole supports the frame and allows it to freely revolve. Thus a user may store jewelry on both sides of the frame and can access each side by revolving the frame. Clips and associated extensions may also be mounted on both sides of a mounting bar region.

The center of mass of the frame should be close to the pivot axis 143 of the stand pole. By "close to" it is meant within 10% of the width of the base. The outer edges of the frame should not extend beyond about the outer edge of the base 144. This will reduce the chance of the Jewelry Organizer Stand tipping over when fully loaded with jewelry, even if said loading is unbalanced.

Figure 2:
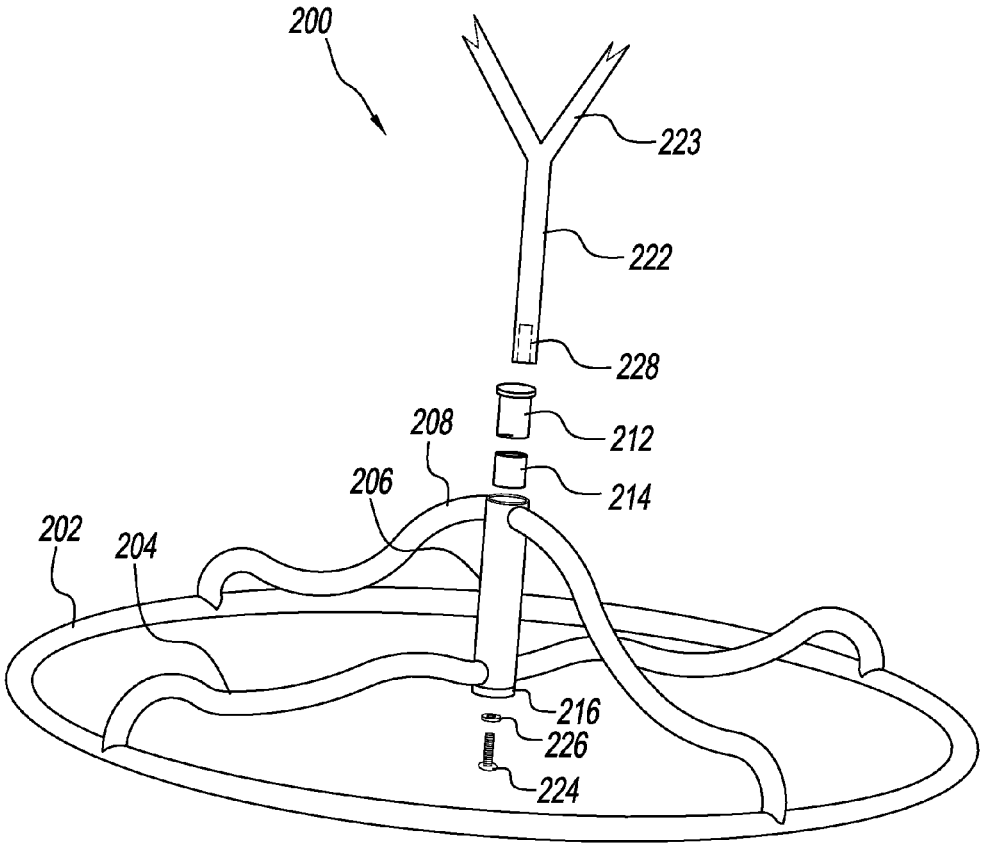
FIG. 2 is a tilted perspective view of a base.

FIG. 2 is an exploded tilted perspective view of a base 200 and a stand pole 222. The stand pole extends from the bottom of the frame 223. The base comprises an outer ring 202, a first and second lower supports 204, a center tube 206, and first and second upper supports 208. The supports connect the center tube to the outer ring. The lower supports are fixedly attached to the bottom of the center tube. The upper supports are fixedly attached to the top of the center tube. Thus the center tube is held in a vertical orientation even if relatively large torques are generated by loading a relatively large amount of jewelry on the frame in an unbalanced manner.

A plastic bushing 212 and bearing sleeve 214 hold the stand pole when inserted therethrough and allow it to freely rotate. The stand pole is secured to the bottom of the center tube by a locking thread screw 224 and a nylon washer 226. The screw is inserted through a hole in a bottom plate 216 of the stand and screws into a receiving hole 228 in the stand pole. The locking threads keep the screw from over tightening or loosening when the stand pole is rotated.

Aluminum tubing is suitable for the base. A suitable outer diameter of the tubing is about 0.953 cm.

Bracelet Hook with Travel Lock

Figure 3A:
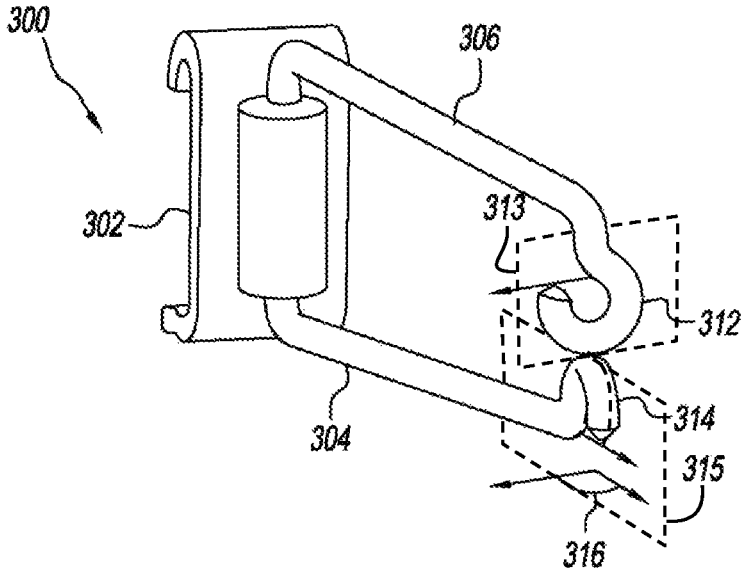
FIG. 3A is a perspective view of a bracelet hook with travel lock.

FIG. 3A is a perspective view of a bracelet hook with travel lock 300. The bracelet hook comprises a clip 302, a bottom arm 304 and an optional top arm 306. The top arm serves as a "travel lock". It will prevent items from slipping off of the bottom arm when the unit is shipped for travel. The bottom arm may comprise a bottom end hook 314. The top bar may comprise a top end hook 312. The median planes of the hooks 313, 315 are at an angle 316 with respect to each other so that the hooks may interlock. About 90 degrees is a suitable angle. When the hooks are joined, they form a closed loop comprising the top arm, bottom arm and clip. Alternative configurations of locking hooks may be used, such as a ring for the bottom end hook. Alternative locking mechanisms may be provided, such as a Velcro® hook and loop closure.

Figure 3B:
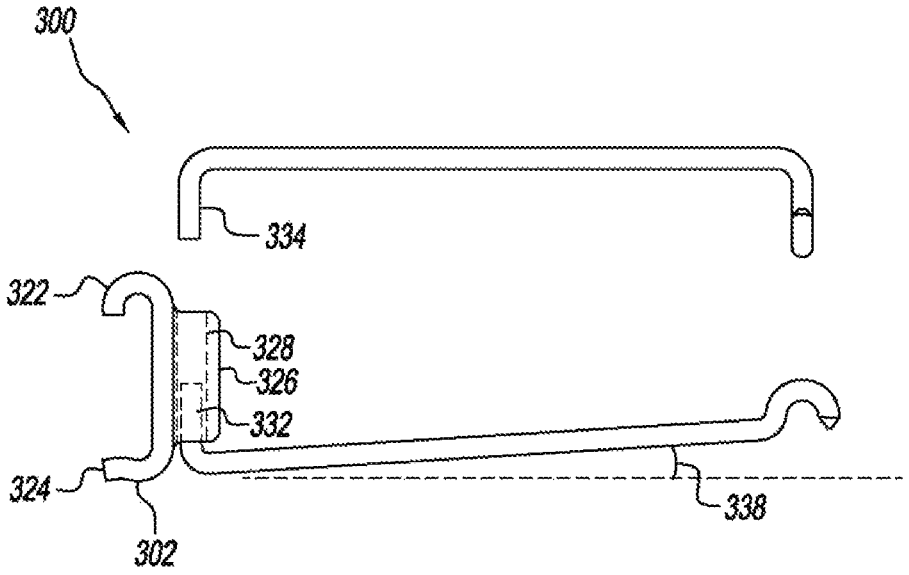
FIG. 3B is an exploded side view of a bracelet hook with travel lock.

FIG. 3B is an exploded side view of the bracelet hook 300 of FIG. 3A. The clip 302 may comprise a horizontal top channel 322, bottom lip 324 and vertical middle cylinder 326. High impact-strength thermoplastic may be a suitable material for the clip. The thermoplastic may have a filler for additional strength. Fiberglass is a suitable filler. Thermoset plastic or metal may also be used. The top channel and the bottom lip are dimensioned so that the clip may be snapped onto the bars of a mounting bar region (116 FIG. 1). The top channel sits on an upper bar and the lip snaps onto a bar below. Thus the user may place an arbitrary number of bracelet hooks in an arbitrary configuration within said mounting bar region. The bottom arm may be slightly angled 338 with respect to horizontal. A suitable angle is in the range of 1 to 10 degrees. A suitable angle within said range is about 4 degrees. The angling will encourage bracelets or any other item mounted thereon to slide towards the clip. Cantilevers may be similarly inclined.

The bottom arm may be fixedly mounted to the clip by inserting a lower pin 332 into the bottom of the middle cylinder. The lower pin may be bonded to the middle cylinder by heat, glue, pressure fit or other joining mechanism.

An upper pin 334 on the top arm may be pivotably mounted to the top 328 of the middle cylinder. The upper pin may be inserted into the middle cylinder without bonding to the middle cylinder so that the upper arm can rotate. The top arm may be secured to the bottom arm by bending said top arm down and linking the top hook with the bottom hook. Once linked, the bending torque on the top bar will secure the upper pin in the hole even if it is free to rotate when not linked to the bottom arm.

A surprising advantage for providing a top arm is that the two arms can be locked and bracelets retained thereupon for moving or shipping of the Jewelry Organizer Stand.

Cantilever Clip

Figure 13:
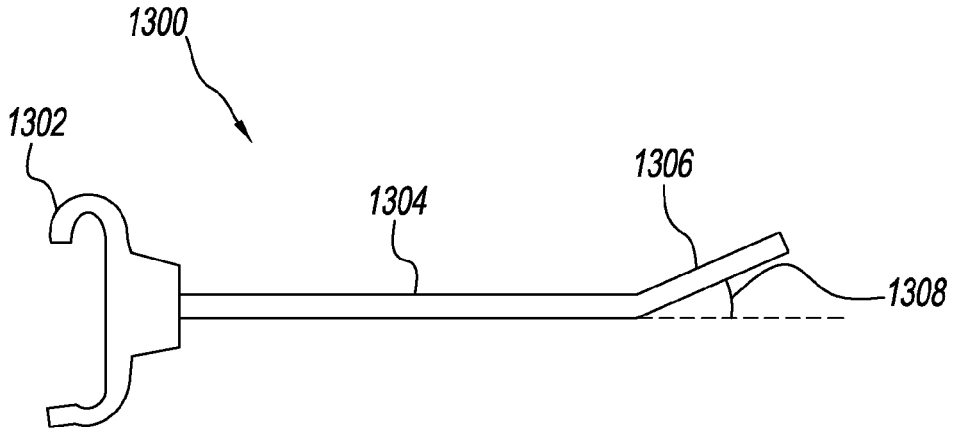
FIG. 13 is a side view of a cantilever clip.

FIG. 13 shows a side view of a cantilever clip 1300. The cantilever clip comprises a clip 1302 and horizontal cantilever bar 1304. The end 1306 of the cantilever bar may be inclined at an angle 1308 with respect to horizontal so that loop-type items placed thereupon will not fall off, even if the cantilever is tilted. The clip is dimensioned to snap onto the bars of a mounting bar region.

Bead Spin-Ring

Figure 4A:
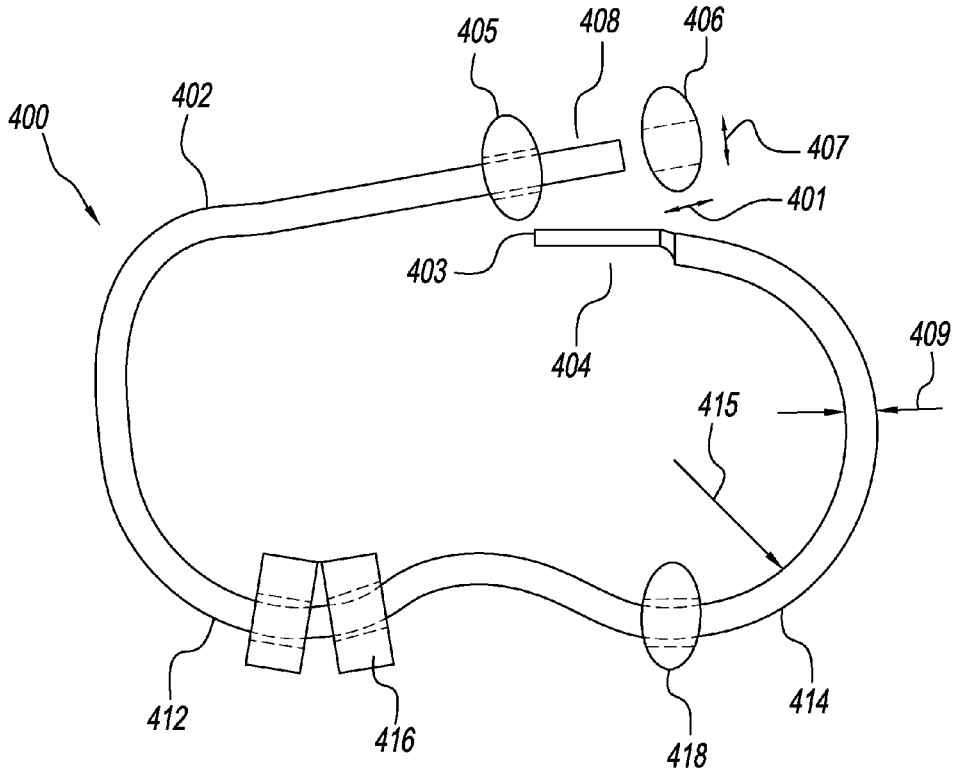
FIG. 4A is front view of a bead spin-ring with the clasp open.

FIG. 4A shows a front view of a bead spin-ring 400 in its open configuration. The spin-ring comprises a length of stiff wire 402 which can be closed into a loop by a clasp 404. The wire may be made of metal, plastic or other stiff material. By stiff it is meant that the wire will return to its original shape if bent within a range of normal use. A range of normal use includes bending the wire to close the loop. The normal shape is the unstressed open configuration. The clasp may comprise a partial cylindrical section 403 which can sit on top of the open end 408 of the wire when the spin-ring is closed. This allows beads 405 stored on said spin-ring to be pushed around said loop of wire in either direction without snagging when said open end is closed.

The spin-ring may comprise two or more undulations 412, 414 on the same side of the spin-ring. A bead spin-ring is suitable for storing beads, charms or other items with a hole that can fit around said wire. Beads may include large-hole beads or charms, such as Pandora® beads.

In operation, beads 406 may be placed on the open end 408 of the bead spin-ring and slide thereon. The bead spin-ring may then be closed and placed on two cantilever clips mounted on a mounting bar region so that the undulations are on the bottom of the spin-ring. The undulations then allow for spaced storage of different types of beads 416 and 418 on the same ring. The different types of beads separately reside in each one of said undulations.

The radius of curvature 415 of the wire and the diameter 409 of the wire should be dimensioned so that the beads will slide freely around the entire wire loop. This will be determined by the internal hole diameter 407 and length 401 of the beads.

Figure 4B:
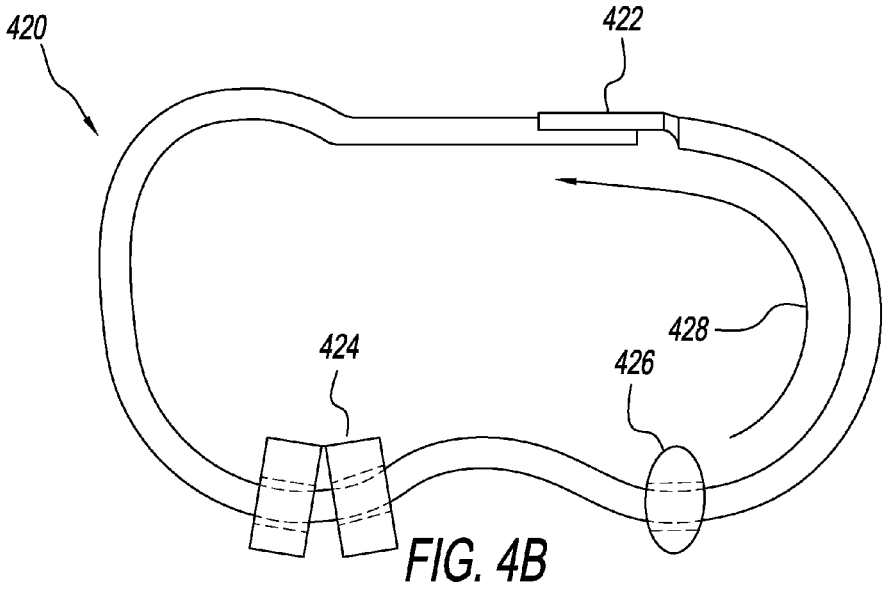
FIG. 4B is a front view of a bead spin-ring with the clasp closed.

FIG. 4B shows a front view of a bead spin-ring 420 in its closed configuration. The closed configuration allows a user to move 428 intervening beads 426 past the closed clasp 422 so that a desired bead 424 may be removed when the clasp is opened. The order of the remaining beads is preserved. There is no need to remove a large number of intervening beads to obtain quick access to a desired bead.

Pendant Spin-Ring

Figure 5A:
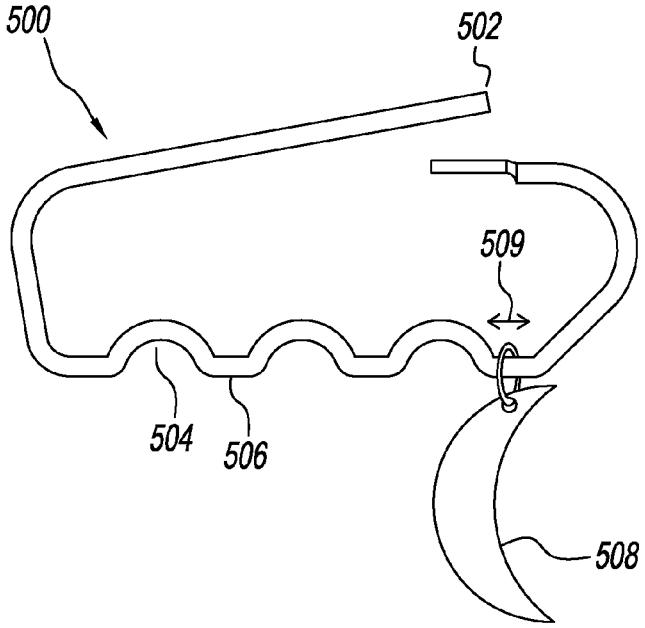
FIG. 5A is a front view of a pendant spin-ring with the clasp open.

FIG. 5A shows front view of a pendant spin-ring 500 in an open configuration. The wire and clasp may be similar to a bead spin-ring. The generic term for a pendant spin-ring and a bead spin-ring is "spin-ring". When the pendant spin-ring is open, pendants or pins 508 may be slid onto the open end 502 and come to rest in undulations 506 that are provided. Pins may be closeable pins, such as safety pins or pins with clasps. The pins close about the wire to stay on the pendant spin-ring. Multiple undulations may be provided with intervening humps 504. The bottom of the undulations 506 may be flat. Thus a pendant or pin will be confined to a region 509 within an undulation, but be able to move within said region. This will allow pendants or pins of different sizes to adjust their positions so that they all can fit side by side without undue interference or overlap. This limits the damage they can cause to each other by colliding and allows them to be seen easily.

Figure 5B:
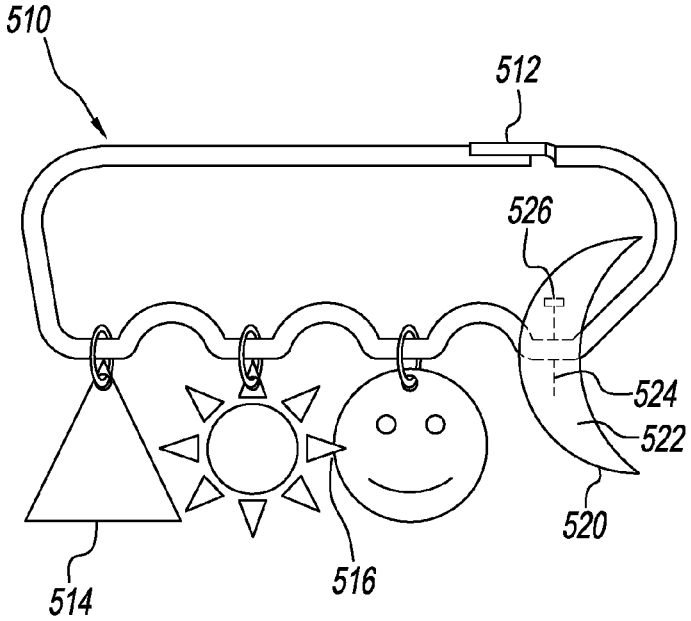
FIG. 5B is a front view of a pendant spin-ring with the clasp closed.

FIG. 5B shows front view of a pendant spin-ring in a closed configuration 510. Multiple pendants 514 and an exemplary pin 520 are shown. Some pendants have a certain amount of overlap 516 when they sit in adjacent undulations on the spin-ring. The overlap is minimized since the pendants are free to move away from each other on the flat portions of the undulations.

The pin 520 comprises a front face 522, rear pin 524 and closure 526.

Similar to the bead spin-ring, the intervening pendants/pins can be moved past the closed clasp 512 so that a desired pendant can be easily removed or added quickly without removing a large number of intervening pendants or changing the order of the remaining pendants.

Ring Bar

Figure 6A:
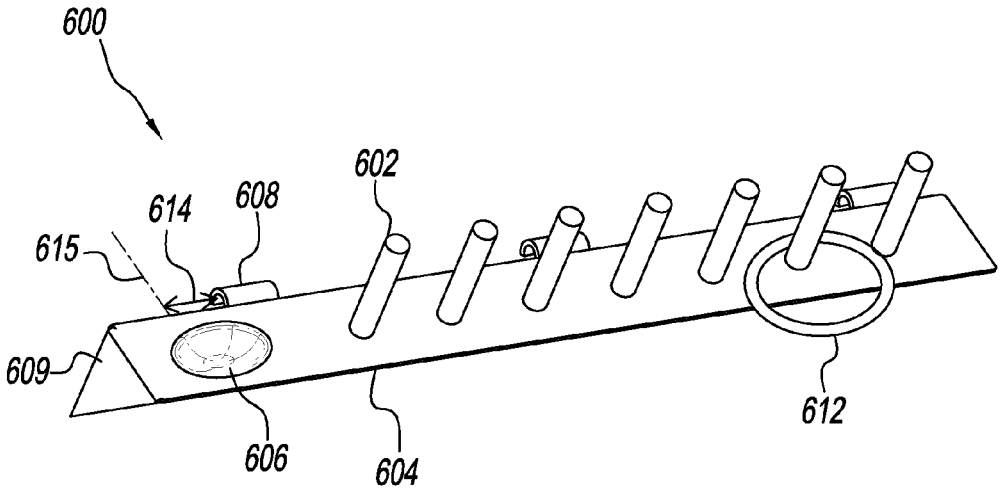
FIG. 6A is perspective view of a ring bar.

FIG. 6A is a perspective view of a ring bar 600. The ring bar comprises one or more posts 602 mounted on a shelf 604 and one or more clips 608 attached to a back wall 609 of the shelf. Rings 612 may be stored on the posts. The clips snap onto the mounting bars (116 FIG. 1) of a mounting bar region. The clips may have similar design to the clips 302 of FIG. 3A. Two clips will provide a more stable mount than one clip. Three clips will provide a stronger mount than two clips. The clips may be offset 614 relative to a symmetric attachment 615 to the shelf so that two ring bars may be mounted back-to-back on the same portion of a mounting bar region without their respective clips interfering with each other.

A cup 606 may be provided in the shelf of the ring bar. The cup may be used to store small items, such as the backings to earrings or post-backed pins. Referring to FIG. 1, if the ring bar is mounted adjacent to the mesh screen region 114, then earrings or post-backed pins may be stored on the mesh screen region and their backings can be stored in said cup. Thus the earrings and their corresponding backings will be in close proximity to each other. As used herein, "close proximity" means that two items can be reached by the movement of a person's hand without said person having to stretch, bend or move his/her feet.

Figure 6B:
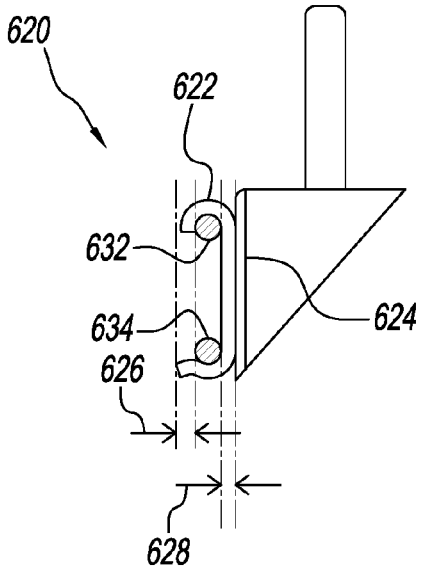
FIG. 6B is a side view of a ring bar.

FIG. 6B shows a side view of a ring bar 620 mounted on two bars 632, 634 of a mounting bar region. The clips 622 may be attached to the back wall 624 of the ring bar. The rear-ward extensions of the clips 626 beyond the mounting bars may be less than or about equal to the clearance 628 of the clips from the back wall to the mounting bars. Thus two ring bars may be mounted back to back on the same portion of the mounting bar region without the clips of one ring bar interfering with the back wall of the other ring bar.

Necklace Bar

Figure 7A:
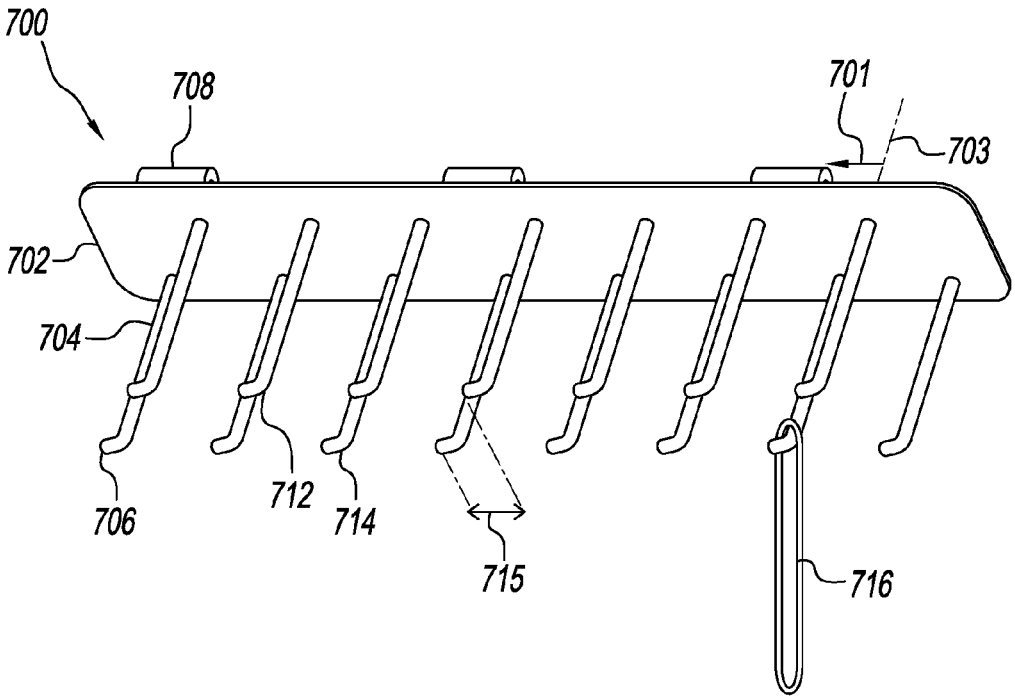
FIG. 7A is a tilted perspective view of a necklace bar.

FIG. 7A is a tilted perspective view of a necklace bar 700. The necklace bar comprises one or more clips 708 similar to the clips of the ring bar. The clips are attached to a backing plate 702. They may be offset 701 relative to a symmetric mounting 703 and have similar clearance constraints as the clips on a ring bar so that two necklace bars may be mounted back to back on the same portion of a mounting bar region without interfering with each other. If a ring bar and a necklace bar have about the same clip configurations, then a ring bar can be mounted back-to-back with a necklace bar.

One or more cantilevers 704 horizontally extend from said backing plate. The cantilevers may comprise upturned ends 706 to help make sure that necklaces 716 stored thereupon will not slide off. There may be two or more rows 712, 714 of cantilevers that are horizontally offset from each other 715 to allow storage and easy access to a large number of necklaces.

Figure 7B:
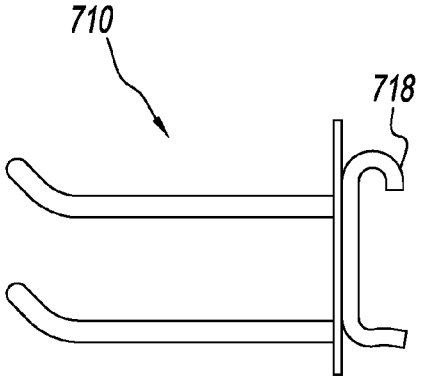
FIG. 7B is a side view of a necklace bar.

FIG. 7B is a side view of necklace bar 710. The shape of the clip 718 is shown.

Loaded Jewelry Organizer Stand

Figure 8:
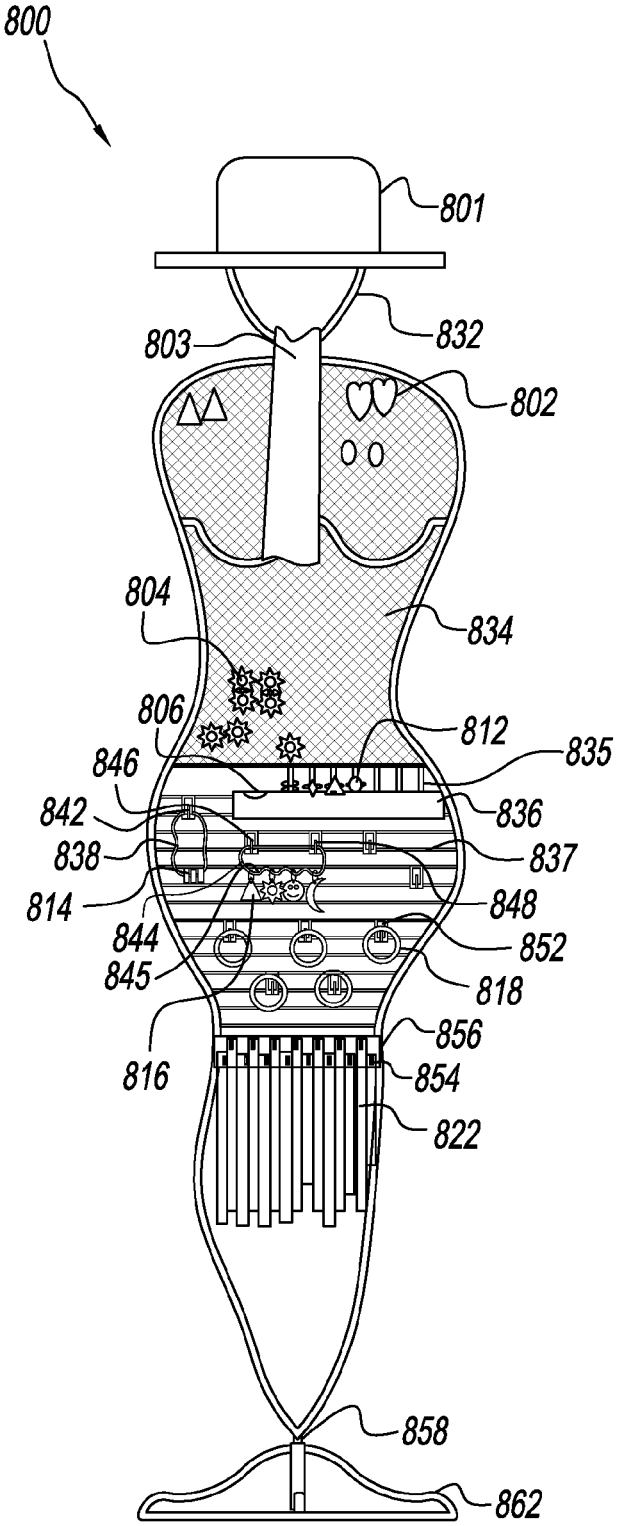
FIG. 8 is a front view of a Jewelry Organizer Stand with a variety of jewelry and accessories loaded on it.

FIG. 8 shows a Jewelry Organizer Stand 800 with an exemplary loading of jewelry and other accessories. A hat 801 is placed on top of the open frame region 832 and a scarf 803 is placed through said open frame region. Post-backed earrings and pins 802 and multiple French hook earrings 804 are placed in the mesh screen region 834. Multiple rings 812 are stored on the posts 835 of a ring bar 836. The ring bar is clipped onto a mounting bar region 837 that is adjacent to the mesh screen region. Multiple earring backings are stored in the cup 806 of said ring bar. Thus the backings are in close proximity to the post backed earrings 802 mounted in said mesh region.

Multiple beads 814 are stored on a bead spin-ring 838. The bead spin-ring is mounted on a single cantilever 842. The cantilever is clipped onto the bars of said mounting bar region.

Multiple pendants 816 are stored on a pendant spin-ring 844. The pendant spin-ring is mounted horizontally on two cantilevers 846, 848 which are clipped onto the bars of the mounting bar region. The undulations 845 are on the bottom of the spin-ring.

Multiple bracelets 818 are mounted on multiple bracelet hooks with travel locks 852. The bracelet hooks are snapped onto the mounting bars of said mounting bar region.

Multiple necklaces 822 are mounted on a plurality of cantilevers 854 of a necklace bar 856. The necklace bar is clipped onto the mounting bars of said mounting bar region.

A comparable loading of jewelry can be provided on the other side of the organizer. Ring and necklace bars are mounted back-to-back of each other on the mounting bar region.

The frame is pivotably attached 858 to the base 862 so that said frame can be freely rotated and thus allow easy access to the jewelry and accessories mounted on each side. Necklace bars may be mounted about 51.0 to 76.2 cm above the bottom of said Jewelry Organizer Stand such that standard sized necklaces mounted on said necklace bar will not hit said base when said frame is rotated.

Jewelry Organizer Stand Styled for a Child

Figure 9B:
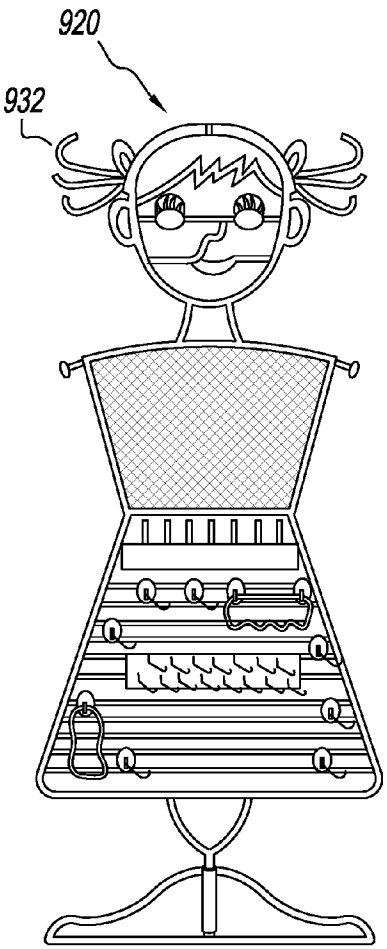
FIG. 9B is a front view of a second alternative embodiment of a Jewelry Organizer Stand suitable for a child.
Figure 9A:
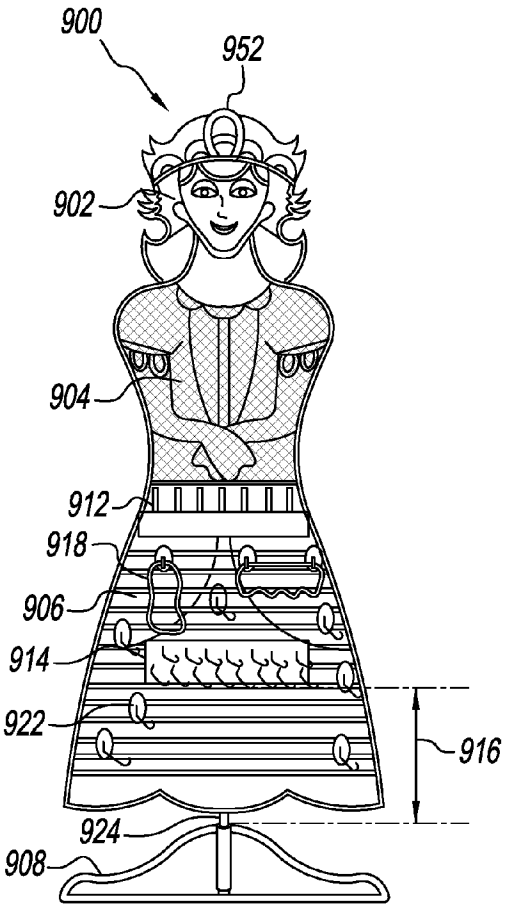
FIG. 9A is a front view of a first alternative embodiment of a Jewelry Organizer Stand suitable for a child.

FIG. 9A shows a Jewelry Organizer Stand 900 which is sized and styled for a child. The stand is shorter than an adult stand. The height may be about that of a typical 5 to 12 year old child. A height of about 147 cm to the top of the head 952 is suitable. The aesthetic style is also appropriate for a child. The aesthetic style of stand 900 is termed "Princess". The Jewelry Organizer Stand comprises an open frame region 902, a mesh screen region 904 a mounting bar region 906. The stand is pivotably mounted on a base 908. A ring bar 912 is provided at waist height. A necklace bar 914 is provided at a height 916 above the top of the base so that necklaces stored thereon will clear the base if the frame is rotated about the base. About 61.0 cm is a suitable height. Spin-rings 918 and cantilevers 922 are also provided. Children may store bows, barrettes, pony tail holders and elastics on the spin-rings. A stand pole 924 may be telescoping to allow the height of the Jewelry Organizer Stand to be increased over time to match the growth of a child.

FIG. 9B shows an alternative child stand 920 with similar features to the stand 900 (FIG. 9A). The aesthetic style of this stand is "Girl". Alternative open frames, such as heads with features and hair protrusions 932 that can be used as hooks, tilting mirrors, personalized child's faces, or other configurations are suitable. Personalized faces may be custom generated from photographs of a child.

Triptych Jewelry Organizer Stand

Figure 10:
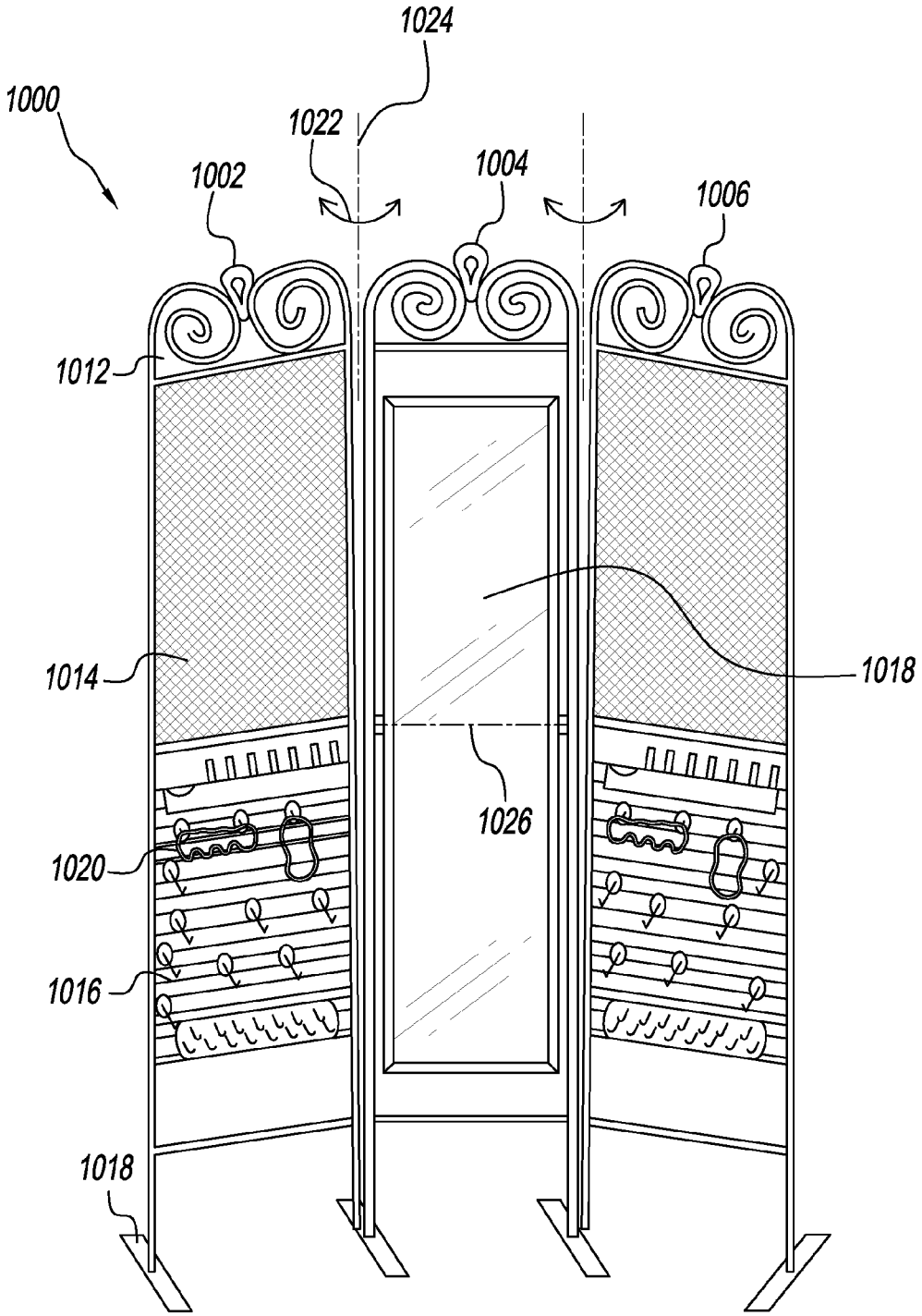
FIG. 10 is a front view of a triptych embodiment of a Jewelry Organizer Stand.

FIG. 10 shows an alternative Jewelry Organizer Stand 1000 in a triptych configuration. The stand comprises a left side panel 1002, a center panel 1004 and a right side panel 1006. The Organizer Stand may be mounted on a T-bar base 1018. Each side panel comprises an open frame region 1012, a mesh screen region 1014 and a mounting bar region 1016. Each side panel is pivotably adjustable 1022 about a hinge axis 1024 connecting said panel to the center panel.

The center panel comprises a mirror 1018. The mirror may be pivotable about its horizontal midline 1026. A selection of clips, spin-rings, and bars 1020 with various extensions may be provided similar to the Venus style embodiment of FIG. 1.

Bustler Jewelry Organizer Stand

Figure 11A:
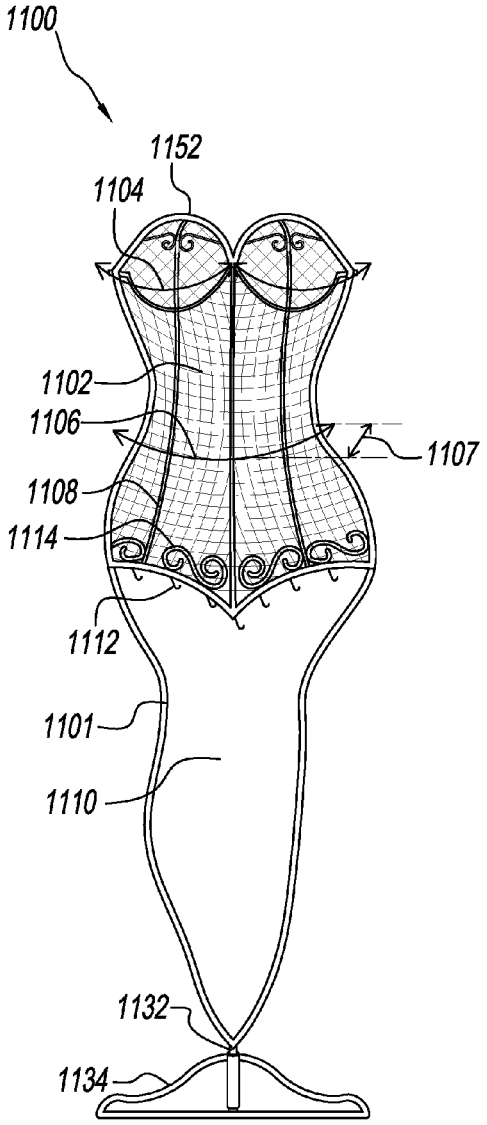
FIG. 11A is a front view of a bustier embodiment of a Jewelry Organizer Stand.

FIG. 11A shows a front view of a bustier style 1100 Jewelry Organizer Stand. The front of the frame 1101 comprises a mesh screen region 1102 and a lower open frame region 1110. A suitable height to the top of the stand 1152 is about 122 cm. The mesh screen region bows towards the viewer 1104, 1106 in a feminine shape. A total bow depth 1107 at the waist of said mesh screen region is about 20.3 cm. Stay bars 1108 may be provided to secure said mesh screen in its feminine shape. Ornamental bars 1114 may also be provided in a filigree configuration. Hooks 1112 may be provided at the top of the open frame region to hang linear items on, such as scarves, belts or hats. The mesh screen region may be provided as a separate piece to be attached to the open frame region with small screws or other fastening means. The two regions can thus be shipped side by side to reduce shipping costs. The Organizer Stand may comprise a stand pole 1132 which extends into a base 1134 and allows said frame to freely revolve.

Figure 11B:
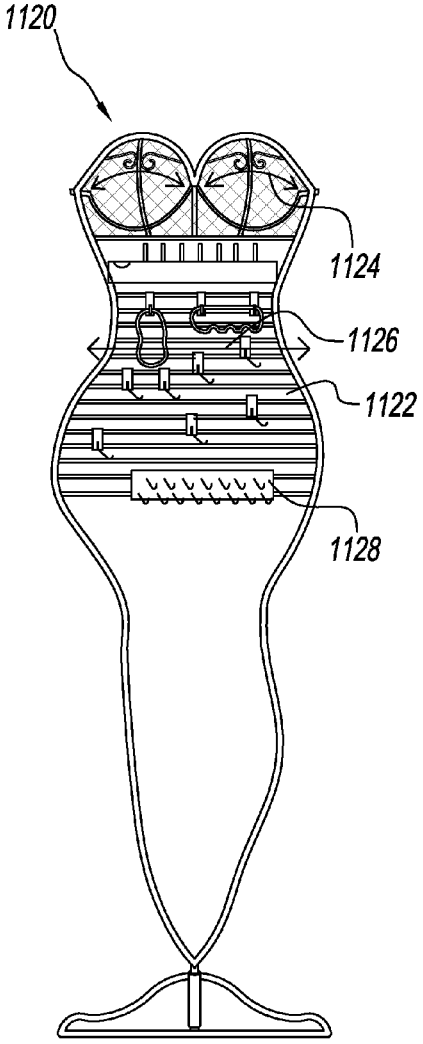
FIG. 11B is a rear view of the bustier embodiment of FIG. 11A.

FIG. 11B shows a rear view 1120 of the bustier embodiment of FIG. 11A. The bowing of the mesh screen region is now seen as concave 1124. A mounting bar region 1122 may be provided on the back side of the frame. The mounting bar region may be flat 1126. It may alternatively be bowed. A selection of clips, spin-rings, and bars 1128 with various extensions may be provided similar to the Venus embodiment of FIG. 1.

Bird Cage Jewelry Organizer Stand

Figure 12:
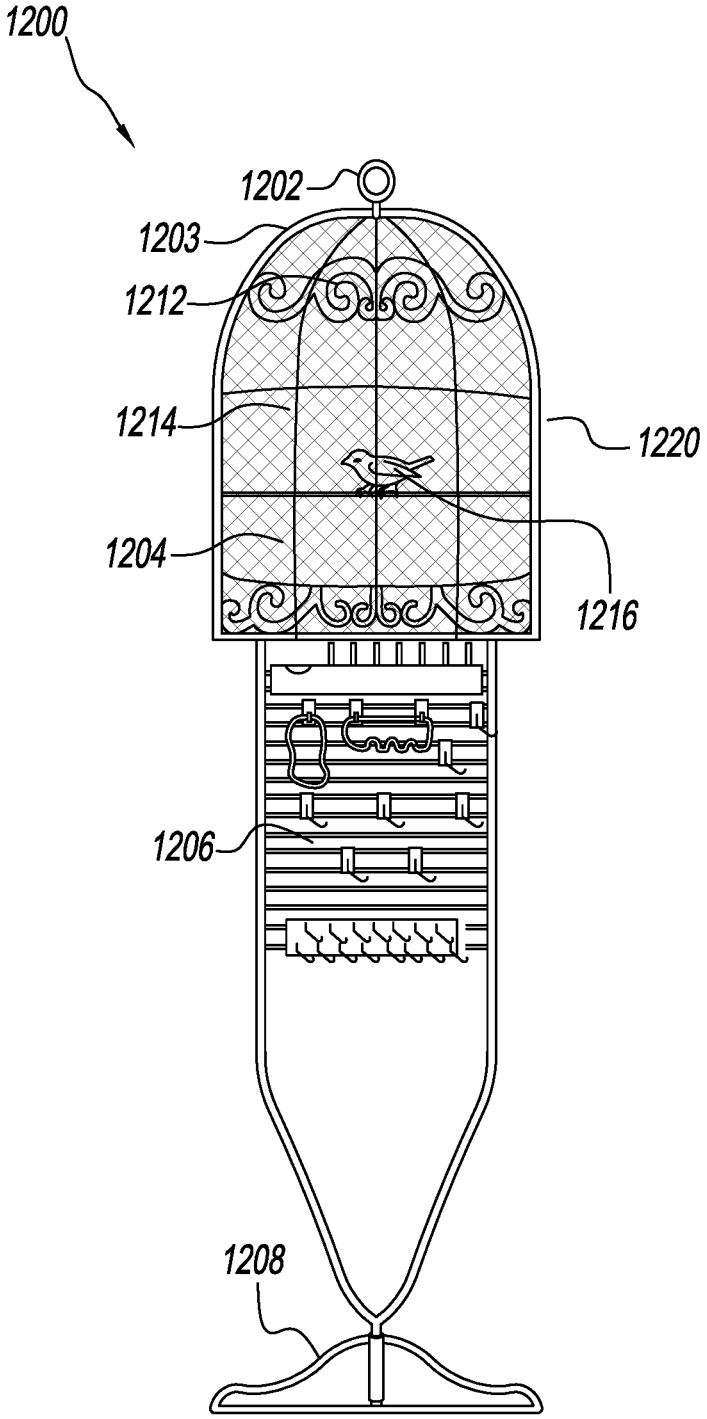
FIG. 12 is a front view of a bird cage embodiment of a Jewelry Organizer Stand.

FIG. 12 shows a front view of a "Bird Cage" style 1200 of a Jewelry Organizer Stand. The frame 1220 may be flat. The frame may comprise an open frame region 1202, mesh screen region 1204 and mounting bar region 1206. The frame is rotatably mounted on a base 1208. The open frame region may be removable, such as by unscrewing from the frame 1203 of the mesh screen region. The mesh screen region may comprise filigrees 1212, cage bars 1214 and a bird FIG. 1216. These may be functional to help support the mesh screen. They may also be aesthetic in simulating a bird cage motif. The overall height of the stand may be about 147 cm. The height and width of the mesh screen region may be about 53.3 cm and 40.6 cm respectively. The height and width of the mounting bar region may be about 33.0 cm and 27.9 cm respectively.

Travel Shipping Features

A number of features may be available that will allow for a Jewelry Organizer Stand to be loaded with jewelry and shipped for personal travel. These features comprise:

a. A Ring Bar travel package comprising:
   i. Velcro® lock for rings—2.54 cm wide Velcro strip with 7 holes corresponding to the 7 ring pins; strip would be 61.0 to 66.0 cm long allowing for 5.08 or more cm of overlap of the Velcro to secure under the bar to lock rings in place;
   ii. Velcro® locks for ring bar—Two shorter 1.27 cm wide Velcro strips to secure the ring bar to the mounting bars; strips would be 20.3 to 25.4 cm long allowing strips to be looped around bar and over and under the two mounting bars to hold ring bar in place;
   iii. Earring backing storage bag—One small [½ the size of a typical Ziploc® snack bag] Ziploc-type bag to place backings for earrings and post-backed pins in for transportation; these would have been kept in the small cup on the ring bar; and
b. Necklace Bar travel package comprising:
   i. Velcro® lock for necklaces—2.54 cm wide Velcro strip with 15 holes corresponding to the 15 hooks on the necklace bar; strip would be 55.9 to 61.0 cm long allowing for 5.08 or more cm overlap of the Velcro to secure behind the bar to lock necklaces in place;
   ii. Velcro® locks for necklace bar—Two shorter 1.27 cm wide Velcro strips to secure the necklace bar to the mounting bars; strips would be 20.3 to 25.4 cm long allowing strips to be looped around bar and over and under the two mounting bars to hold ring bar in place; and
   iii. Velcro® lock for dangling portion of necklaces—One Velcro strip to wrap around the dangling portion of the necklaces [around the 'knee' area of the stand] to secure the lower parts of the necklaces and limit tangling; 2.54 cm wide and 45.7 to 55.9 cm long to allow 5.08 or more cm of overlap of the Velcro.

Alternative embodiments of a Jewelry Organizer Stand may comprise any individual features described above or any combination of individual features described above. For example a Jewelry Organizer Stand, such as the bustier embodiment of FIG. 11A, may comprise a mesh screen region but no mounting bar region. The Jewelry Organizer Stand can also be used to store and display tools (e.g. hammers, saws), fishing tackle (e.g. tied flies and associated tools for the creation thereof), cooking utensils, or other items that have one or more of a pin, ring or linear topology as described above.

Having thus described a presently preferred embodiment of the present invention, it will be understood by those skilled in the art that many changes in construction and widely differing embodiments and applications of the invention will suggest themselves without departing from the scope of the present invention as defined in the claims. The disclosures and the description herein are intended to be illustrative and are not in any sense limiting of the invention, defined in scope by the following claims.

We claim:

1. A bracelet hook comprising:

a) a clip comprising a front and a back;

b) a top arm extending horizontally from said front of said clip; and c) a bottom arm extending horizontally from said front of said clip wherein:

d) said bottom arm is below said top arm;

e) said top arm comprises a top end hook at its distal end dimensioned to join with said bottom arm to form a closed loop comprising said top arm, said bottom arm and said clip;

f) said clip comprises a vertical middle cylinder on said front of said clip, said vertical middle cylinder comprising a top and a bottom;

g) said top arm comprises a downward directed upper pin at its proximal end;

h) said bottom arm comprises an upward directed lower pin at its proximal end;

i) said upper pin is inserted in said top of said vertical middle cylinder; and j) said lower pin is inserted in said bottom of said vertical middle cylinder.

2. The bracelet hook of claim 1 wherein said back of said clip comprises:

a) a top channel; and b) a bottom lip wherein said top channel and bottom lip are dimensioned to snap onto two parallel horizontal bars.

3. The bracelet hook of claim 1 wherein:

a) said top end hook is described by a median plane;

b) said bottom arm comprises a bottom end hook at its distal end, said bottom end hook being described by a median plane; and c) said median plane of said top end hook is at an angle with respect to said median plane of said bottom end hook such that said top end hook may interlock with said bottom end hook.

4. The bracelet hook of claim 3 wherein said angle is about 90 degrees.

5. The bracelet hook of claim 3 wherein said bottom end hook is a loop.

6. The bracelet hook of claim 1 wherein:

a) said upper pin is pivotably mounted in said top of said middle cylinder; and b) said lower pin is fixedly mounted in said bottom of said middle cylinder.

7. The bracelet hook of claim 1 wherein said bottom arm is angled 1 to 10 degrees with respect to horizontal.

8. The bracelet hook of claim 1 wherein said clip is made of plastic and said top and bottom arm are made of metal.

* * * * *